US008276219B2

(12) United States Patent
Dubiel

(10) Patent No.: US 8,276,219 B2
(45) Date of Patent: Oct. 2, 2012

(54) ADJUSTABLE POTTY TRAINING SEAT WASTE DISPOSAL RECEPTACLE AND LINER

(75) Inventor: David Dubiel, Goffstown, NH (US)

(73) Assignee: Optilife Products Inc., Goffstown, NH (US)

( * ) Notice: Subject to any disclaimer, the term of this patent is extended or adjusted under 35 U.S.C. 154(b) by 0 days.

(21) Appl. No.: 12/900,081

(22) Filed: Oct. 7, 2010

(65) Prior Publication Data

US 2011/0030134 A1 Feb. 10, 2011

Related U.S. Application Data

(62) Division of application No. 11/545,143, filed on Oct. 10, 2006, now abandoned.

(51) Int. Cl.
*A47K 11/06* (2006.01)

(52) U.S. Cl. ..... 4/484; 4/479

(58) Field of Classification Search ..... 4/239, 235, 4/237, 234, 902, 483, 484, 479
See application file for complete search history.

(56) References Cited

U.S. PATENT DOCUMENTS

| | | | | | |
|---|---|---|---|---|---|
| 799,935 | A * | 9/1905 | Parker | 4/239 |
| 1,978,871 | A * | 10/1934 | Thuren | 4/484 |
| 2,332,658 | A * | 10/1943 | Muller | 4/239 |
| 2,687,535 | A * | 8/1954 | Almorth | 4/239 |
| 5,412,815 | A * | 5/1995 | Ellis | 4/239 |
| 5,978,976 | A * | 11/1999 | Chai | 4/483 |
| 6,339,851 | B1 * | 1/2002 | Bergkvist | 4/239 |

* cited by examiner

*Primary Examiner* — Gregory Huson
*Assistant Examiner* — Karen L Younkins
(74) *Attorney, Agent, or Firm* — Daniels Patent Law PLLC; Scott A. Daniels

(57) ABSTRACT

A potty seat, liner system is provided wherein the seat liner (9) is supported in a receptacle (7) by resting in the contours of a pee deflector (79) and an indentation (81). The receptacle (7) rests inside a seat (5), which is supported by a base (3). Furthermore, the liner (9) can be removed and folded onto itself to enclose waste therein. When not used with the base (3), the seat (5) is provided with an adjustment mechanism to facilitate securing the seat (5) to any desired adult sized toilet seat.

17 Claims, 7 Drawing Sheets

ADJUSTABLE POTTY TRAINING SEAT WASTE DISPOSAL RECEPTACLE AND LINER

This application is a Divisional Application of prior U.S. patent application Ser. No. 11/545,143 filed, Oct. 10, 2006 now abandoned which is now U.S. Publication No. US-2008-083061-A1 published Apr. 10, 2008.

FIELD OF THE INVENTION

This invention relates to an infant toilet seat which includes a seat ring and an adjustment mechanism for fitting the seat ring to a toilet bowl or a conventionally sized adult toilet seat as well as a waste receptacle and disposable liner. More particularly, this invention relates to a child training potty seat including the adjustment mechanism and the waste receptacle and liner having ergonomic contouring to facilitate potty training for children, as well as the waste receptacle and liner being capable of use with an adult commode. The waste receptacle liner conforms to the ergonomic contouring of the waste receptacle and is formed in such a manner for being readily removed and disposed of.

BACKGROUND OF THE INVENTION

Toilet seats and potty training seats are well known in the prior art. Potty seats and chairs include, for example, U.S. Pat. No. 6,339,851 to Bergkvist and relate to a toilet seat ring having an adjustable pair of arms which are movably mounted on the seat ring and capable of being brought synchronously to positions in which they engage the toilet bowl or seat upon which the seat ring is supported. Such known adjustment mechanisms are not easily readjusted for different size toilet seats and have lots of complicated moving and interacting parts such that fabrication of the adjustment mechanisms becomes very expensive.

Other seat positioning arms used prior to the present application have been adapted to engage directly on the inside or on the outside of a toilet bowl or against the inside or outside of a seat ring that is already fitted to the toilet bowl and are individually adjustable. These known seat positioning devices, along with known fixed position, i.e. non-adjustable potty seats, have the drawback of not enabling the toilet seat to be readily positioned exactly on toilet bowls and not fitting toilet seats of different sizes and shapes. For example, some toilet seats define a relatively oval opening while others have a relatively round opening. This can lead to difficulty in potty-seats, both fixed and adjustable ones, fitting either design and can have the unwanted consequence of movement of the potty-seat during use because of the adjustable seat not being adequately stabilized by the adjustment means.

Potty-seats are most generally equipped with a rigid seat ring that can rest upon the toilet rim or seat and support itself thereupon. This rigid seat ring is the sole support to the liner system, but can fall into the toilet if not properly aligned when the excessive weight of the liner pulls down. In response to this problem, additional inventions were created to provide more support to the liner. Such inventions include those with drawstrings and inner containers to fasten and support the potty seat liner in the potty-seat. These drawstrings may provide some benefits, such as simple removal and additional support, however, the known liners and drawstrings do not provide sufficient coverage of the supporting inner container especially where there is a need to have a more ergonomically adapted inner container to collect all of a user's waste. Furthermore, such drawstrings and toilet liners can be soiled to the extent that not all the user's waste is encompassed within the bag or also leave a small opening where the drawstrings were unable to fully close the liner, thereby allowing waste to escape.

The use of potty-chair disposable waste receptacles is known in the prior art, for example, in Abbot, U.S. Pat. No. 6,625,823 is disclosed a waste receptacle having a disposable bag member adapted to a flat flange-like collar and a bag closure consisting of a draw string for closing the bag after use. More specifically, potty-chair disposable waste receptacles are generally obvious structural configurations not unlike the ancient chamber pot design and notwithstanding the myriad of designs encompassed by the crowded prior art in this field which have been developed.

In addition, most of the potty-seat and liner apparatus are designed as a flat or minimally rounded upper surface similar to a conventional toilet seat. This does not always accommodate the user especially where a child, for example, may not be entirely positioned correctly atop the potty-seat and without completely comprehending the anatomical alignment necessary to direct their waste into the container such misorientation can result in the waste not being properly aimed into and collected within the liner.

SUMMARY OF THE INVENTION

One object of the present invention is to overcome the above-mentioned shortcomings of the prior art.

Another object of the present invention is to provide an adjustable potty seat which can be adjusted to securely fit any type, shape or design of toilet seat.

A further object of the present invention is to provide an adjustable bracket to secure the potty-seat from moving or sliding around when a user is seated thereon.

A still further object of the invention is to provide a rear protruding bracket which pushes the potty seat to the front of the adult toilet aiding the user to sit in a more natural, legs hanging down seated position and can be used on either an elliptical or a round adult toilet seat.

Another object of the invention is to provide a potty seat receptacle and liner system which is structurally capable of collecting all waste therein.

Still another object of the present invention is to provide a potty seat receptacle which is ergonomically conformed to a user and facilitates the collection of waste.

A still further object of the invention is to provide a potty-seat receptacle liner which fully covers the receptacle so that all of a user's waste is collected and can be sealed, or closed and folded in such a manner so as to completely seal waste therein for disposal.

The present invention also relates to a toilet seat comprising a seat having an upper surface and a lower surface defining a seat opening therethrough; at least a stop depending from the lower surface of the seat to align the seat with at least one of another toilet seat and a toilet bowl; and an adjustment mechanism slidably supported on the lower surface of the seat which is radially extendable relative to the seat to abut a surface adjacent to the seat wherein the adjustment mechanism is radially slidable in a linear direction substantially opposite to the stop depending from the lower surface of the seat. The toilet seat further comprising a linear track formed on one of the lower surface of the seat and the adjustment mechanism, and a spring biased engagement device for engaging in the linear track supported on the other of the lower surface of the seat and the adjustment mechanism.

The present invention also relates to a waste receptacle for a toilet seat comprising a rigid container with a horizontal flange having an outer edge and an inner edge defining an opening; an ergonomigraphical inner wall depending from the inner edge of the flange and extending to a bottom wall to form an interior cavity of the container; a pre-formed liner having a horizontal flange portion defining a liner opening and an inner wall portion depending therefrom and extending to a bottom wall portion to define an interior cavity portion substantially matching the ergonomigraphical inner wall of the rigid container.

The present invention also relates to a method of collecting waste in a waste receptacle for a toilet seat comprising the steps of forming a rigid container comprising a horizontal flange having an outer edge and an inner edge defining an opening; defining an ergonomigraphical inner wall depending from the inner edge of the flange and extending to a bottom wall to form an interior cavity of the container; and pre-forming a liner with a horizontal flange portion defining an opening and an inner wall portion depending therefrom and extending to a bottom wall portion to define an interior cavity portion substantially matching the ergonomigraphical inner wall of the rigid container.

In order to attain the above objects, one aspect of the present invention provides an adjustable potty-seat and liner system which comprises an adjustable base supporting a seat defining an opening and removably coupled to the seat, a receptacle with an extending pee guard at a front end and a depending indentation at a rear end and the receptacle being configured to be received by the seat, and a liner which is contoured to fit the extending pee guard and depending indentation in the receptacle.

BRIEF DESCRIPTION OF THE DRAWINGS

By way of example, the invention will now be described with reference to the accompanying drawings in which.

DETAILED DESCRIPTION OF THE INVENTION

Figure 1:
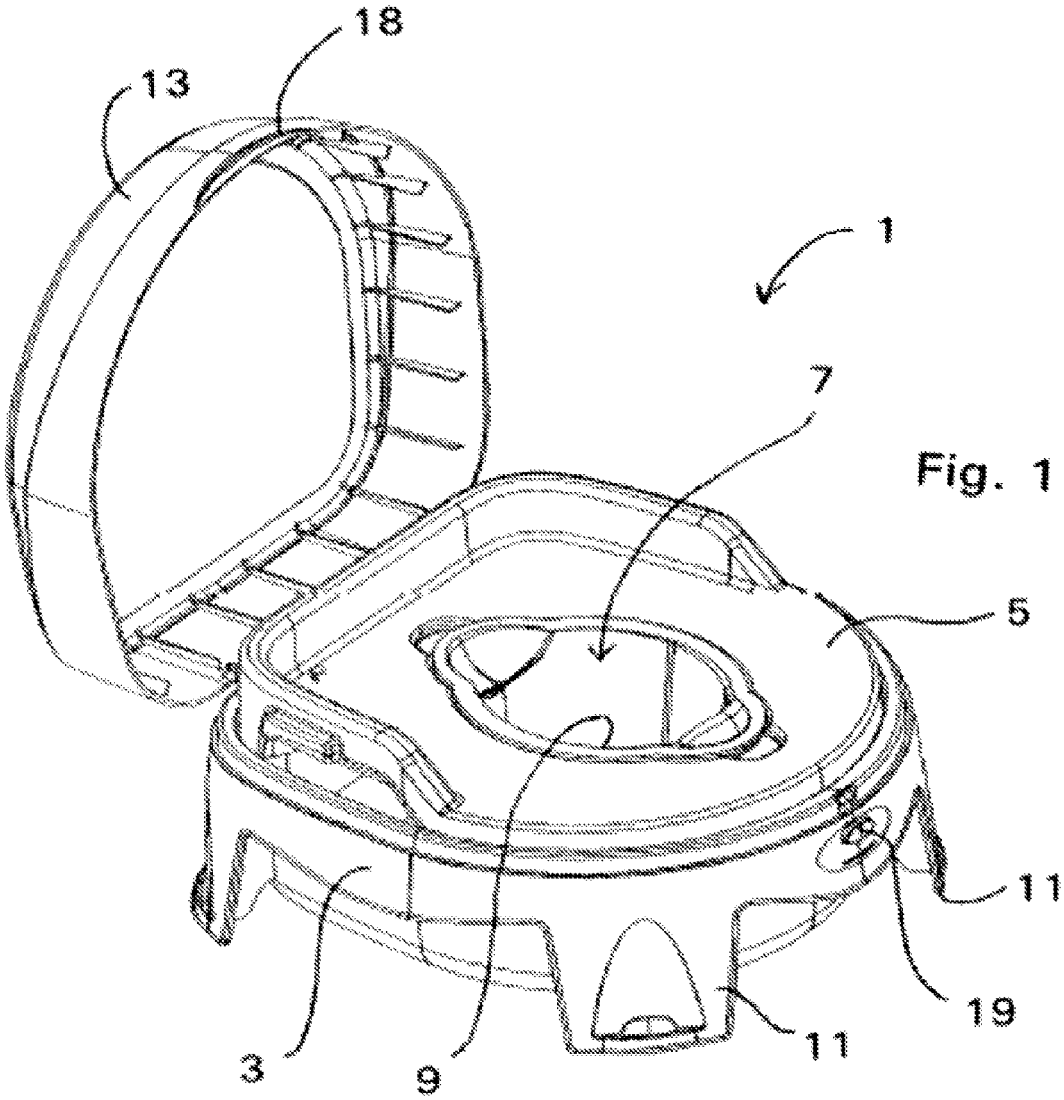
FIG. 1 illustrates a perspective view of an assembled stand-alone base embodiment of the potty-seat, waste receptacle and liner system.

Observing FIG. 1 and FIG. 2, a general description concerning the various components of the present invention will now be discussed. Referring to FIG. 1, a potty seat system 1 of the present invention is illustrated, in general, having a base 3, a seat 5, a waste receptacle 7, and a waste receptacle liner 9. In one embodiment, the base 3 is supplied so that the potty seat system can rest on the ground, via a plurality of depending legs 11, and directly supports the seat 5 which is supported thereon. A hinged cover 13 may also be provided and attached to the base 3 to cover the seat 5, waste receptacle 7 and liner 9 supported therein. It is to be appreciated that in another embodiment neither the base 3, nor the waste receptacle 7 and liner 9 are necessary where the seat 5 is to be used directly on a conventional, adult sized toilet.

Figure 2:
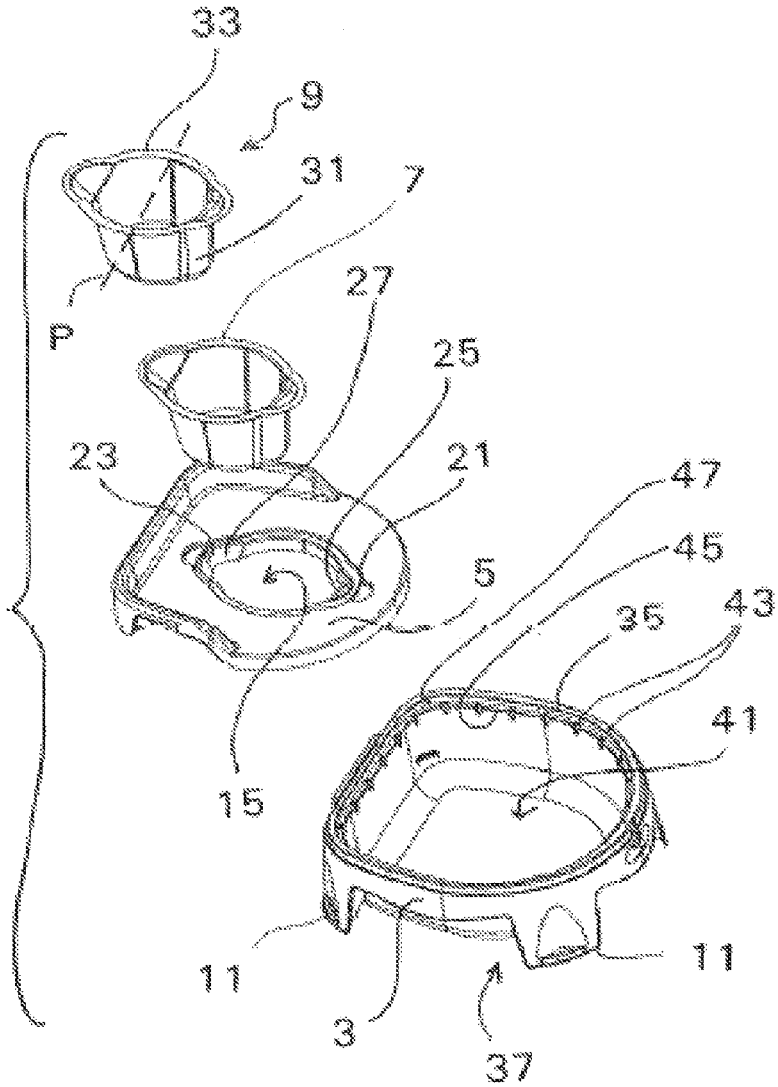
FIG. 2 illustrates an exploded view of one embodiment of the potty-seat, waste receptacle and liner system in conjunction with a stand-alone base.

Observing FIG. 2, the seat 5 defines a seat opening 15 and receives the waste receptacle 7 therein in such a manner that the receptacle 7 and/or the liner 9 can be easily removed once the liner 9 is used. Since the seat 5 is supported on top of the base 3 in this first embodiment, the legs 11 of the base 3 provide sufficient clearance so that the receptacle 7 and liner 9 which depend down below the seat 3 are supported solely by the seat 3 and slightly spaced above the ground.

The waste receptacle 7 fits down into the seat opening 15 which has an ergonomic modified, trilliptical-shaped rim with a front 21 and a back 23. The front 21 defines a substantially vertically upward extending pee guard 25, and the back 23 is defined by a substantially downwardly depending indentation receiving wall 27. Importantly, the liner 9 has a bag portion 31 and a rim portion 33 which is molded in a manner to conform with the entire inner surface of the waste receptacle 7. In addition, the rim portion 33 of the liner 9 is provided with a hinge or fold axis P about which the rim 33 folds, or hinges so that the opposite sides of the rim portion 33 can be folded against one another and matchingly engaged to seal or close the bag portion 31 of the liner 9 for disposal after use.

As seen in FIG. 2, in the first embodiment of the potty-seat system where an adult sized, conventional toilet is not utilized, the base 3 provides the primary structural support for the potty seat system. The base 3 has a top portion 35 and a bottom portion 37 wherein the top portion 35 defines a base opening 41 for insertion and support of the seat 5. The base opening 41 may be provided with a series of air vents 43 formed in an inner ledge 45 extending around the circumference of the base opening 41 upon which the seat 5 is supported when inserted thereon. The bottom portion 37 of the base 3 has a number of legs 11 for supporting the potty seat system off the floor. Four legs 11 are shown in the present embodiment, however, any number of legs 11 may be provided or, for even more stability, the legs 11 may even be a substantially completely circumferential skirt around the base 3 which supports the potty seat system. While the base 3 can typically be round, elliptical, square or even a combination of shapes, any suitable shape may be used so long as structural stability for support of the seat 5 is obtained.

As discussed above, the top portion 35 of the base defines a base opening 41 whereby the seat 5 can be removably supported. The inner ledge 45 is formed around the inside of the base 3 to vertically support the seat 5, as well as horizontal containment of the seat 5 due to a ridge or wall 47 on the base 3 adjacent the inner ledge 45. This ridge or wall 47 which surrounds a lower most edge of the seat 5 when the seat 5 is positioned on the base 3 to keep the seat 5 from sliding transversely or horizontally out of contact with the base 3. In the alternative, the attachment of the seat 3 can also be a hinged design or the seat 5 can snap onto the base 3 with a series of snap fittings (not shown) for a more fixed attachment. If operating with the hinged design, the base 3 can have hinges (not shown) attached allowing the seat 5 to rotate upon the base 3 similar to a conventional toilet seat.

Returning to FIG. 1, this first embodiment of the base 3 discloses the cover 13 which can be hinged to the base 3 to cover or enclose the potty seat system, when desired. The cover 13 has a contiguous top and side edge surface 17 which is typically contoured to match an outer edge of the base so as to provide a complete enclosure of the seat 5, receptacle 7 and liner 9 when not in use. The cover 13 may be provided with a handle and a latch 18 for engagement with a spring loaded button 19 in the base 3. Once the button 19 is pushed, the handle and latch 18 are released and the cover 13 can be raised to provide the user access to the seat 5.

Figure 3:
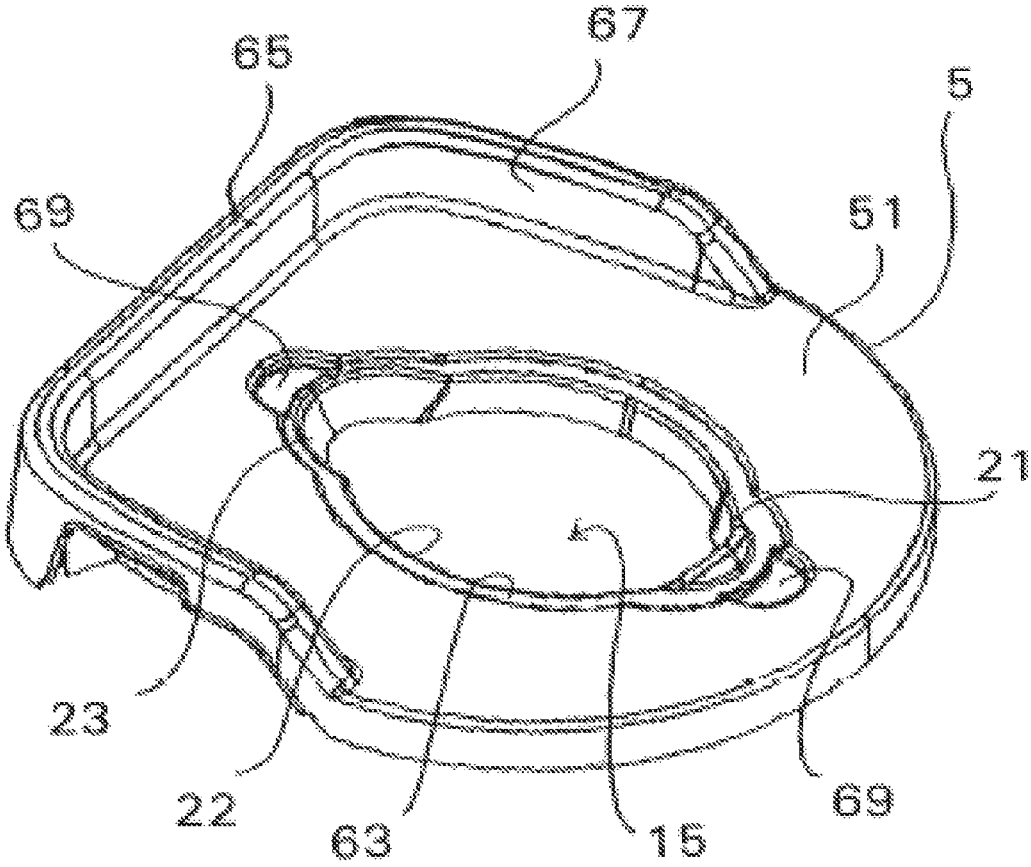
FIG. 3 is a perspective view of the potty seat and seat opening.

Turning to FIG. 3, the seat 5 has a top surface 51 which defines the seat opening 15 for receiving the receptacle 7 and the liner 9 therein. The seat opening 15, similar to the receptacle 7, described in further detail below, is formed in a modified elliptical outline, hereinafter referred to as a trilliptical profile, having a semi-elliptical, front portion 21 and similarly shaped semi-elliptical, back portion 23 joined by an elliptical, intermediate portion 22. The contiguous nature of these three semi-elliptical profiles 21, 22, 23 define a trilliptical profile of opening 15. The front and back portions 21, 23 are shaped for respectively receiving the substantially matching semi-elliptical receptacle flange 59 to be discussed in further detail below. In addition, the trilliptical profile 21, 22, 23 of the seat opening 15 may be further defined by a stepped down supporting flange 63 being slightly lower relative to the top surface 51 of the seat 5, i.e., slightly lower than the top surface 51 of the seat 5 so that the bottom of the receptacle flange 59 rests thereon and an outer surface of the receptacle flange 59 sits relatively evenly with the top surface 51 of the seat 5.

On a top surface of the seat 51 is positioned a raised back wall 65 and side edges 67 extending at least partially circumferentially around the outer rim of the seat 5. The back wall 65 and side edges 67 are raised 1-3 inches and preferably about 2 inches above the top surface 51 of the seat 5 to provide a positioning device whereby a child can judge their relative positioning on the seat 5, and furthermore use the raised side edges 67 to grasp with their hands and adjust their own relative body positioning on the seat 5, if need be.

Finally, an access divot or depression 69 may be placed somewhere along and directly adjacent the seat opening 15 so that the receptacle flange 59 and/or the liner flange 77 may be easily grasped. The access depression 69 may be formed deeper, i.e., lower, relative to the top surface of the seat 51 than the supporting flange 83 so as to enable a user to place their fingers below the outer edge of the receptacle 7 and liner flanges 77 and thus easily remove either item from the seat opening 15.

Figure 4:
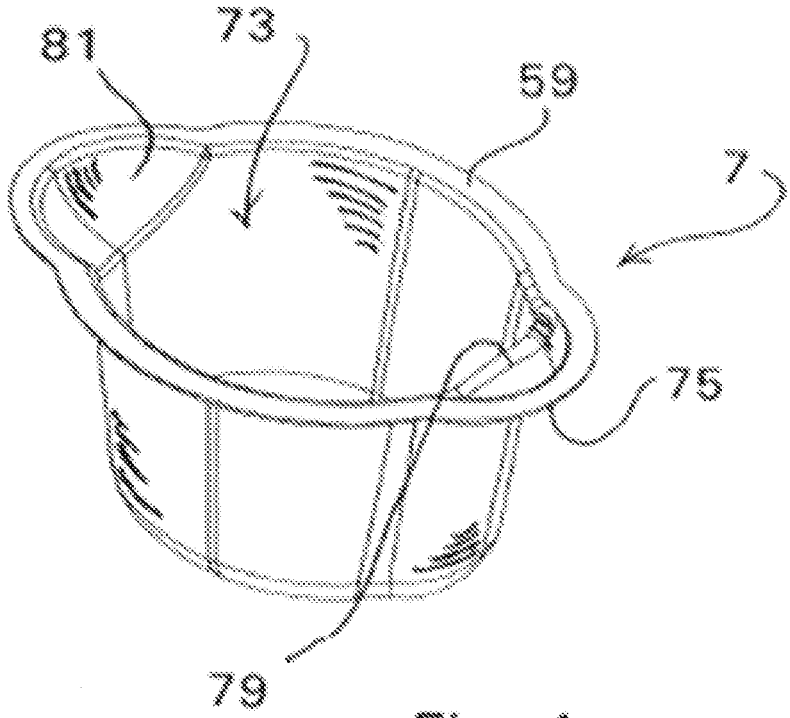
FIG. 4 is a perspective view of the receptacle for insertion in the opening of the potty-seat.

Observing FIG. 4, the waste receptacle 7 is shown in conjunction with an un-inserted liner juxtaposed above it. The waste receptacle 7 is a generally rigid structure and has a voluminous receiving cavity 73 for receiving the bag portion of the liner 9 and coincidentally a user's waste. Around the top edge of the receptacle 7, and defining a receptacle opening 15 leading to the receiving cavity 73, is the receptacle flange 59. The receptacle flange 59 has a bottom surface 75 for directly engaging with a support ledge 63 of the seat opening 15 to support the liner 9 within the seat opening 15.

On the front of the receptacle 7 and positioned adjacent the receptacle flange 59 is the vertically upward, extending pee deflector 79, which is a scalloped, semi-elliptical and radially curved lip extending convexly above the receptacle flange 59. The pee deflector 79 extends upwards from about 0.25 of an inch to 1.5 inches, but generally rises above the flange 59 in a range of about 0.5 to 1.0 of an inch. The pee deflector 79 extends radially along the front end of the receptacle 7 for about 1-3 inches and preferably about 2 inches so as to provide sufficient radial coverage along the flange 59 so that a user, usually a male child who may not have developed sufficient aiming skills, will ideally have their urine stream impact against an inner, scalloped surface of the pee deflector 79, which is contiguous with the inner wall of the receiving cavity 73. The urine is thus subsequently directed down into the receiving cavity 73 of the waste receptacle 7.

Directly opposite the pee deflector 79, and at the back of the receptacle 7 is formed the concave indentation 81 can also be contiguously integrated into the inner sidewalls of the receptacle 7. The indentation 81 forms a convex depression below the receptacle flange 59. This indentation 81 serves two purposes, first, in the case of a user not being centered on the seat and being positioned too close to the back of the seat 5, the indentation provides further volume to the receptacle 7 to direct waste into the receiving cavity. Secondly, and in regards to the functionality of the liner 9, the indentation 81 is sized volumetrically larger than the pee deflector 79. The indentation 81 defines a volume corresponding to the indentation portion 82 of the liner 9 which, as will be discussed in further detail below, when the liner 9 is removed from the receptacle 7 and folded along its fold or hinge axis P for disposal, the pee deflector portion 80 of the liner 9 fits entirely within the volume of the receiving area defined by the indentation portion 82 of the liner 9.

Figure 5:
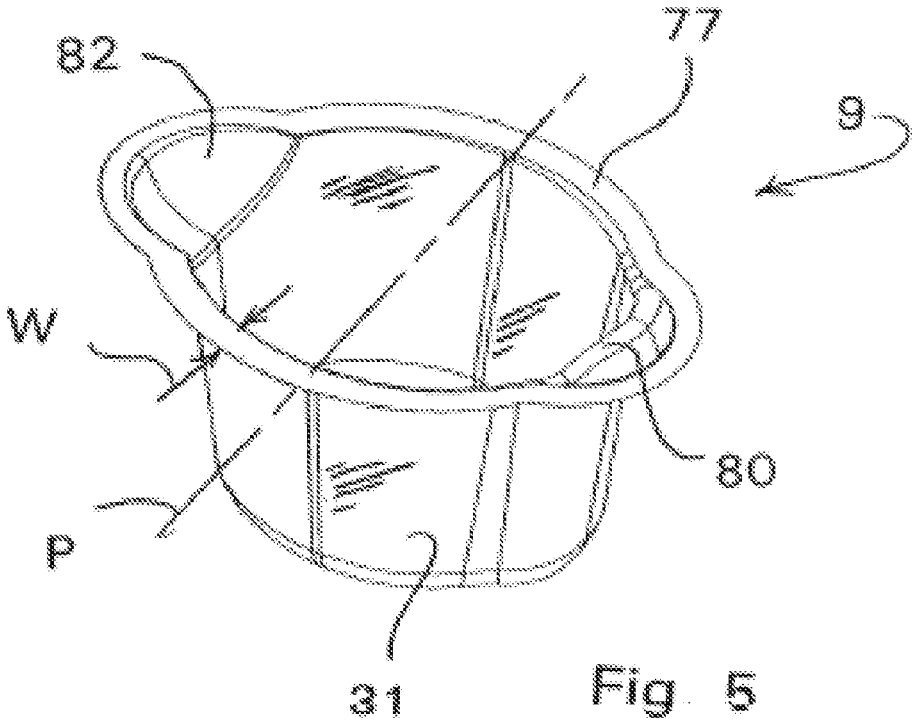
FIG. 5 is a perspective view of the liner for insertion in the waste receptacle of the potty-seat.

FIG. 5 illustrates the liner 9 which is inserted within the receptacle 7 to directly receive the user's waste and then facilitate disposal of the same. The liner 9 is a relatively flexible material and can be formed from a polymeric material or other flexible, non-porous material to receive and contain the user's waste. The liner 9 can be flexible to facilitate folding of the liner 9 about the hinge or fold axis P, but is pre-formed in a manner to directly conform to the shape, size and contours of the receptacle 7.

The liner 9 is pre-formed with a liner flange 77 substantially conforming in trilliptical profile the receptacle flange 59. The liner flange has a width substantially conforming to the width of the receptacle flange 59 so as to rest thereon and completely cover the receptacle flange 59 when the liner 9 is inserted within the receptacle 7. Adjacent the liner flange 77, the rim portion 33 of the liner 9 defines a pee deflector portion 80 and an indentation portion 82 to correspondingly match with the respective pee deflector and indentation 79, 81 formed on the receptacle 7. From the liner flange 77 and the noted pee deflector portion 80 and indentation portion 82, the bag portion 31 of the liner 9 depends contiguously downwards to define a volume substantially similar to that of the receiving cavity 73 of the receptacle 7. The liner 9 including the liner flange 77, pee deflector portion 80 and indentation portion 82 is pre-formed prior to insertion into the receptacle 7 to the same dimensions and contours of the inner surface of the receiving cavity 73 of the receptacle 7, as well as pre-formed to the ergonomigraphical contours defined by the convexly extending pee deflector 79 and the concavely depending indentation 81. Ergonomigraphical features are contoured structures consisting generally of peaks and valleys which substantially conform to a human body portion to facilitate use of the structure.

The material of which the liner 9 is formed is manually pliable and flexible, but ergonomigraphically pre-formed in a manner to attain and retain the same ergonomigraphical shape as the receptacle 7 prior to insertion therein. This pre-formed shape is maintained by the liner 9 both prior to and during insertion and use and will substantially exactly match and intimately correspond to the noted contours and dimensions of the receptacle 7 when the liner 9 is inserted therein.

Further, the upper portion of the liner 9 which forms the liner flange 77 as well as the pee deflector portion 81 and indentation portion 82 of the liner 9, may be comprised of a thicker amount of material in relation to the bag portion 31 of the liner 9. Such thicker material can help in maintaining the pliable but pre formed shape of the liner 9 before the liner 9 is inserted within the supporting receptacle 7. Also, the flange portion of the liner 9 may have a slightly greater width W so as to extend outside the corresponding receptacle flange 59 to easily differentiate and grip the liner 9 by running the fingers along the flanges and separating the two flanges 59, 77 facilitating removal of the liner 9 from the receptacle 7

Figure 6:
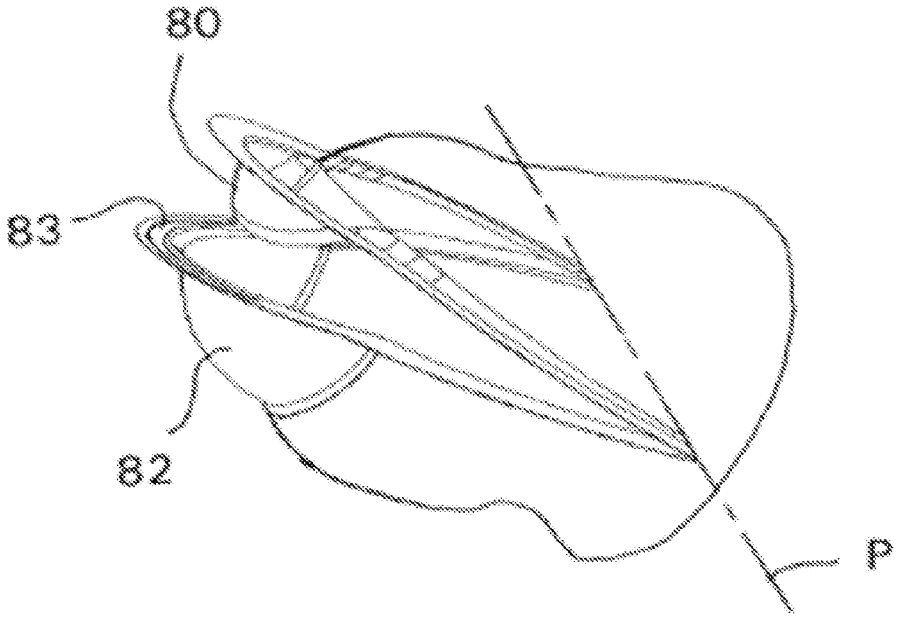
FIG. 6 is a perspective view of the liner as it is folded over on itself.

In FIG. 6 the liner 9 is shown in a partly folded configuration with the liner flange 77 folding along the hinge or fold axis P. As is readily apparent, the opposing halves of the liner flange 77 are folded over atop one another along the fold axis P so that the corresponding opposite top surfaces of the flanges are brought into contact. One of the opposite top surfaces of the liner flanges 77 may support an adhesive strip 83 thereon to facilitate sealing engagement of the opposing halves of the liner flanges 77 to one another. An adhesive strip 83 that extended from the fold axis P may extend circumferentially around either half of the liner flange 77 to about the fold axis P on the opposite side of the liner 9. Such an adhesive strip 83 would provide for complete sealing of the contents of the liner 9. The adhesive may include a release strip (not shown) to shield the adhesive from the user of the potty seat, liner system. The release strip can be comprised of a paper material and may include a release tab (not shown) for easy gripping and removing of the strip. When it is desirable to remove the liner 9 from the receptacle 7 and dispose of the liner 9 and any contents, the release strip is removed from the adhesive and the liner flange 77 can be folded over and onto itself, secured by the adhesive strip 83 and disposed of accordingly.

Figure 7:
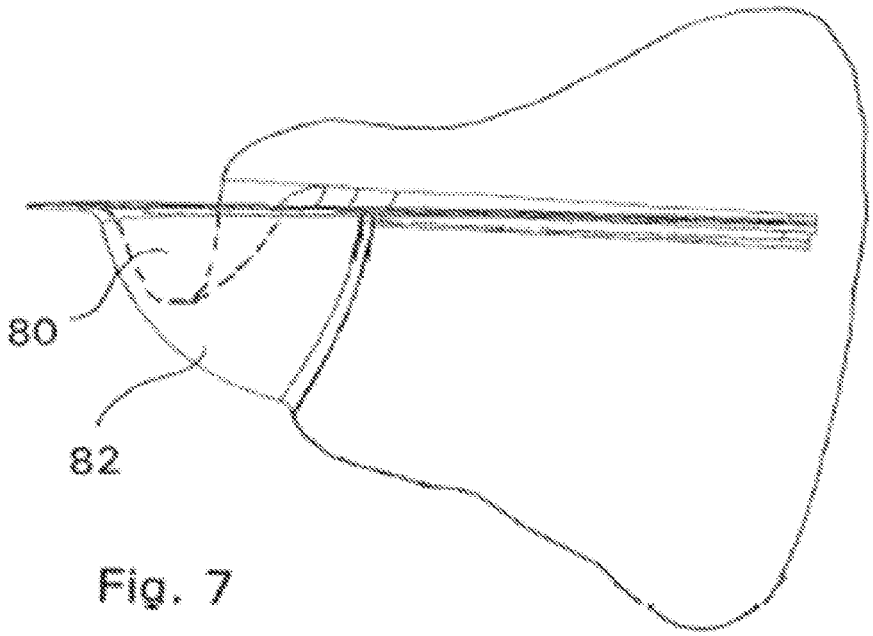
FIG. 7 is a side view of liner completely folded over and sealed or closed on itself for disposal.

The pee deflector portion 80 of the liner 9 is significantly smaller in volume and surface area than the indentation portion 82, this is important for, as seen in FIG. 7, when the liner flange 77 is completely folded over on itself the pee deflector portion 80 is nested down inside of the indentation portion 82 and thus provides no impediment to complete closure and sealing of the liner flange 77 to itself. So that the pee deflector portion 80 is received within the indentation portion 82 without any interference therewith it is also important for the radially outermost surface of the pee deflector portion 80 to be spaced closer to the hinge or fold axis P than the radially outermost surface of the indentation relative to the fold axis P. This ensures that when the half of the flange with the pee deflector portion 80 is folded over atop the half of the liner flange 77 with the indentation, or vice-versa, the outermost surface of the pee deflector portion 80 is not impeded by the outermost surface of the indentation portion 82. In other words, the pee deflector portion 80 is sized and positioned relative to the indentation portion 82 so that the pee deflector 80 can be fully received and encompassed within the indentation portion 82 during the fold and seal operation.

Figure 8:
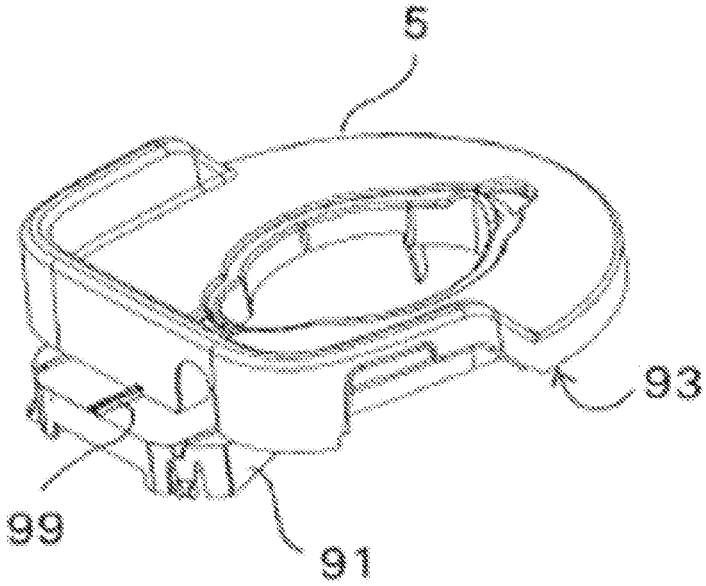
FIG. 8 shows the seat and relative adjustment mechanism.
Figure 9:
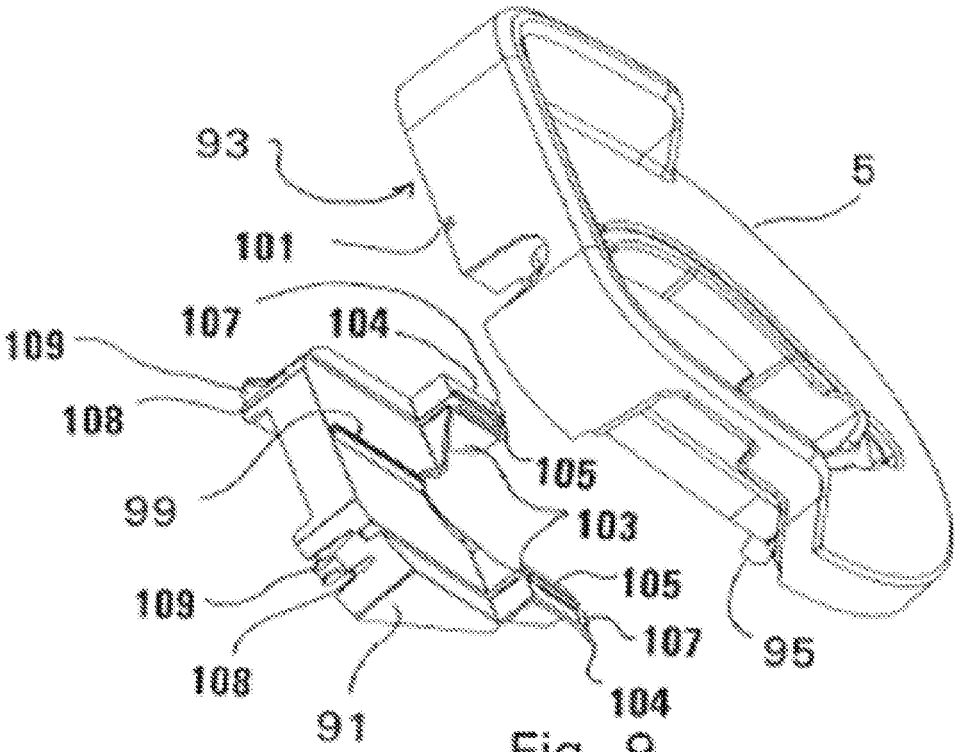
FIG. 9 shows the top surface of the adjustment mechanism which slides along the bottom of the seat.
Figure 10:
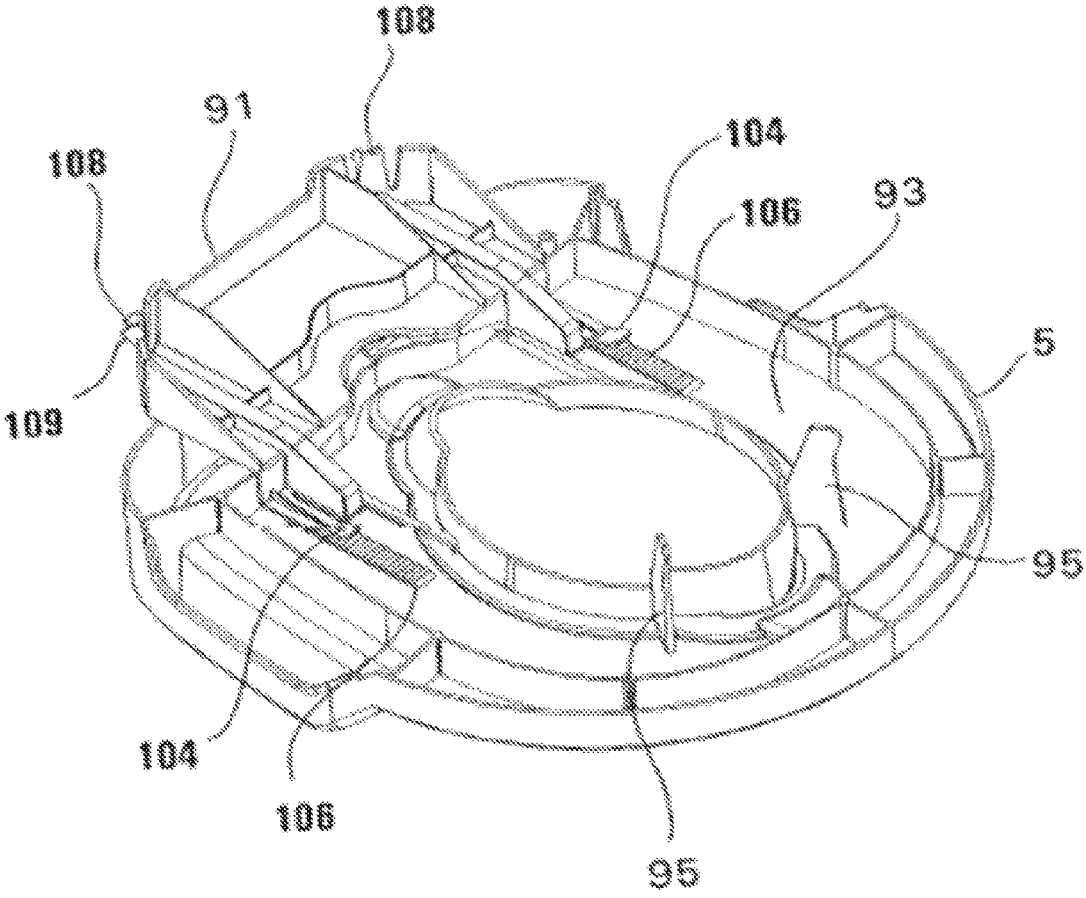
FIG. 10 is a perspective view of the underside of the seat and the attachment of the adjustment mechanism to the seat.

Turning to FIGS. 8-10 a further discussion of the seat 5 and the adjustment mechanism 91 is provided. The seat 5 includes on its underside 93 the adjustment mechanism 91 which can adjust the seat 5 to fit onto a variety of differently shaped and sized adult, toilet seats. As seen in FIG. 8, the adjustment mechanism 91 is slidably supported on the underside 93 of the seat 5 for slidable, linear transverse movement of the adjustment mechanism 91 relative to the seat 5. This adjustment mechanism 91 can be extended from the back of the seat 5 and about even with the back edge of the seat 5 up to about 4 inches, and more preferably about 2-3 inches from the seat 5. The underside 93 of the seat 5 also includes a pair of depending front stops 95 for engaging with a front inside edge of the adult sized, toilet seat. The depending front stops 95 are located forward on the underside 93 of the seat 5 and assist in initially locating the seat 5 on the adult sized, toilet seat in a forward aligned manner so that the seat 5 and seat opening 15 is closer to the front outer edge of the adult sized, toilet seat than the rear edge. This allows a more comfortable seating position for the user, usually a child, so their legs can hang off and down the front of the toilet bowl and not have to uncomfortably straddle the toilet for instance where the seat is positioned too far rearward on the adult sized, toilet seat.

FIG. 9 shows the top surface 97 of the adjustment mechanism 91 which slides along the bottom of the seat 5. The adjustment mechanism 91 includes a centering rib 99 located on the top surface 97 which engages with a centering slot 101 located on the underside 93 of the seat 5. A pair of arms 103 extends forward on the adjustment mechanism 91 and these arms 103 have inner side ribs 105 which engage in corresponding slots formed on the underside 93 of the seat 5. Both the centering rib 99 and the inner side ribs 105 maintain the adjustment mechanism 91 in a substantially parallel and planar alignment with the underside 93 of the seat 5 and ensures that the adjustment mechanism 91 extends in and out from the seat 5 in a straight and level manner.

FIG. 10 is a perspective view of the underside of the seat 5 and the attachment of the adjustment mechanism 91. The adjustment mechanism 91 is adjusted in its linear extension relative to the underside 93 of the seat 5 via a pair of leaf springs 104 and engaging teeth 106. The leaf springs 104 are formed integrally with the support arms 103 and extend forwardly relative to the seat 5 in a parallel manner on either side of the seat opening 15. As can be appreciated, at least an engagement tooth 107 is provided on the underside 93 of the spring arms 103. The engagement tooth 107 is for relative engagement between the adjustment teeth 106 formed on the underside 93 of the seat 5.

In order to move the adjustment mechanism 91, either towards or away from the seat 5, an operator has merely to provide an upward pressure on the ends of the leaf spring 104 to release the respective engagement tooth 107 from the respective engagement teeth 106 and with the aforementioned slots guiding the linear in and out movement of the adjustment mechanism 91 relative to the seat, slide the adjustment mechanism 91 in the desired direction either towards or away from the seat 5. When the desired positioning is reached, the user usually lets go of the leaf spring 104 and the integral nature of the leaf springs 104 biases the tooth 107 into engagement between the relative engagement teeth 106 on either side of the underside 93 of the potty seat 5. Other types of adjustment mechanisms could be used in place of the leaf spring and tooth, however the above discussed arrangement is particularly important because it allows a substantially large range of minute adjustments in order to fit any particular adult sized, toilet seat known in the art.

It is to be appreciated that when the user performs the above noted adjustment, the front stops 95 are placed abutting the inside front edge of the adult size, toilet seat. The user may then pull up on the leaf springs 104 and move the adjustment mechanism 91 either in or out relative to the inside rear edge of the adult sized, toilet seat in order to provide a snug fit between the adjustment mechanism 91 positioned against the inside rear edge of the adult sized toilet seat and the front stops 95 aligned against the inside front edge of the adult sized toilet seat opening. In addition, a pair of vertically aligned leaf springs 108 may be provided on the back end surface of the adjustment mechanism 91 and provided with a protrusion 109 to provide a biased snap fit adjustment underneath the adult sized, toilet seat. With the ends of the protrusion angled and the relative flexibility of the vertical leaf springs, it is readily apparent that the protrusions 109 can be pushed underneath the rear edge of the adult sized toilet seat in order to provide further frictional engagement therewith.

The inherent flexibility of the vertical aligned leaf springs 108 allows these protrusions 109 on the leaf springs 108 to pass by the inner edge of the toilet seat without further adjustment of the adjustment mechanism 91 if it is desired for example to take the seat on, and off the same toilet repeatedly.

In general with the seat accordingly situated on an adult sized, toilet seat as discussed above, neither the receptacle 7 nor the liner 9 is usually necessary. With the seat 5 situated on the base 3, as previously described, the receptacle 7 may be set within the seat opening 15 and a liner 9 is inserted into the receptacle 7. The liner 9 is aligned such that the pee deflector portion 80 of the liner 9 is fit over the pee deflector 79 on the receptacle 7 and the indentation portion 82 of the liner 9 is similarly fit into the indentation portion 81 of the receptacle 7. In this manner, the liner flange 77 sets itself on top of the receptacle flange 59 and substantially the entire exposed surface of the receptacle 7 is covered by the liner 9. A second liner can even be inserted over the first liner before use so that quick removal of used liners can be performed while leaving another liner in-place and ready to be used.

To remove the liner 9 from the seat 5 and receptacle 7, an operator need only to insert their fingers slightly into the depression 69 and below the edge of the liner flange 77 and then grasping an edge of the liner flange 77. The liner 9 can then be lifted free of the receptacle 7 and closed, folded and/or sealed to contain the waste. To close and seal the liner 9, the operator removes the protective strip to reveal the sticky adhesive layer underneath. The operator need only fold the liner flange 77 about the fold line P and insert the pee deflector 80 into the indentation portion 82 then press the opposing flange halves of the liner 9 against one another to activate the adhesive sealing the liner 9 into a substantially closed state.

The adjustable embodiment can operate to fit all variety of adult sized, toilet openings and, therefore, allows a more versatile potty seat liner system. To operate the seat 5, one must first adjust the seat 5 by using the adjustment mechanism 91. The tooth 107 should first be removed from engagement of the teeth 106 in the track by lifting on the leaf spring 104 with the fingers with a force sufficient for disengagement. The leaf spring 104 can then be moved into the appropriate position by sliding the adjustment mechanism 91 along the slot 101.

The materials used in the potty seat system can vary from element to element, but can usually be polymeric in nature. The base 3, seat 5, and receptacle 7 can all be comprised of plastics materials, low density polyethylene, or low density polyethylene. Other suitable polymers for the above structural elements include polyethyleneterephthalate, polyvinyl chloride, polypropylene, polystyrene, polytetrafluoroethylene, polyurethane, polyamide, and polyacrylamide, for example. For the liner 9, high density polyethylene can be optimal, but any flexible material capable of containing human waste is acceptable.

Therefore, the foregoing is considered illustrative only of the principles of the adjustable potty seat and liner system. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A toilet seat comprising:

a seat having an upper surface and a lower surface defining a seat opening therethrough;

at least two stops depending from the lower surface of the seat to align the seat with at least one of a toilet seat and a toilet bowl; and an adjustment mechanism slidably retained on the lower surface of the seat which is linearly extendable beyond an outer edge of the seat to abut a rear inside edge of the toilet seat adjacent to the seat; and wherein the seat and seat opening are aligned closer to an inside front edge of the toilet seat then the rear inside edge of the toilet seat.

2. The toilet seat as set forth in claim 1 wherein the adjustment mechanism is slidable in a linear direction substantially opposite to the stops depending from the lower surface of the seat.

3. The toilet seat as set forth in claim 2 wherein the adjustment mechanism further comprises at least two leaf springs which biasly engage a track on the bottom surface of the seat in order to secure the adjustment mechanism relative to the seat.

4. The toilet seat as set forth in claim 1 wherein the adjustment mechanism is positioned on the underside of the seat adjacent the outer edge of the seat and the adjustment mechanism moves linearly and radially relative to the outer edge to abut the surface adjacent to the seat and facilitate abutment of the stops with a forward inner edge of one of the other toilet seat and toilet bowl.

5. The toilet seat as set forth in claim 4 further comprising a linear track formed on one of the lower surface of the seat and the adjustment mechanism, and a spring biased engagement device for engaging in the linear track supported on the other of the lower surface of the seat and the adjustment mechanism.

6. The toilet seat as set forth in claim 1 further comprising:

a rigid container comprising a horizontal flange having an outer edge and an inner edge defining an opening;

an ergonomigraphical inner wall depending from the inner edge of the flange and extending to a bottom wall to form an interior cavity of the container;

a pre-formed liner having a circumferential horizontal flange portion defining a liner opening and an inner wall portion depending therefrom and extending to a bottom wall portion to define an interior cavity portion substantially matching the ergonomigraphical inner wall of the rigid container.

7. The toilet seat as set forth in claim 6 wherein the ergonomigraphical inner wall of the rigid container comprises an axially extending pee guard and a radially extending scalloped depression formed adjacent the flange.

8. The toilet seat as set forth in claim 7 wherein the axially extending pee guard and the scalloped depression are integrally formed with the inner edge of the flange to define the ergonomigraphical inner wall.

9. The toilet seat as set forth in claim 7 wherein the inner wall portion of the liner is pre-formed to match the axially extending pee guard and the scalloped depression features of the inner wall of the rigid container.

10. The toilet seat as set forth in claim 7 wherein the horizontal flange portion is sized to overlap the horizontal flange of the rigid container to fully protect the rigid container from any waste.

11. The toilet seat as set forth in claim 8 wherein the axially extending pee guard comprises an axially and radially curved surface extending partially circumferentially around the opening of the rigid container.

12. The toilet seat as set forth in claim 11 wherein the pre-formed axially extending pee guard portion of the liner also comprises an axially and radially curved surface portion matching the dimensions of the axially and radially curved surface of the pee guard extending partially circumferentially around the opening of the rigid container.

13. A method of using a toilet seat comprising:

providing a seat having an upper surface and a lower surface defining a seat opening therethrough;

forming at least two stops depending from the lower surface of the seat to align the seat with at least one of another toilet seat and a toilet bowl; and actuating an adjustment mechanism slidably supported on the lower surface of the seat which is radially extendable relative to a rearward edge of the seat to abut a rear inside edge of the toilet seat adjacent to the seat; and aligning the seat and seat opening closer to a front inside edge of the toilet seat then the rear inside edge of the toilet seat.

14. The method of using the toilet seat as set forth in claim 13 further comprising the step of radially sliding the adjustment mechanism in a linear direction substantially opposite to the stops depending from the lower surface of the seat.

15. The method of using the toilet seat as set forth in claim 14 further comprising the step of biasly engaging at least two leaf springs with a track on the bottom surface of the seat in order to secure the adjustment mechanism relative to the seat.

16. The method of using the toilet seat as set forth in claim 13 further comprising the step of positioning the adjustment mechanism on the underside of the seat adjacent a rearward edge of the seat and the adjustment mechanism moves linearly and radially relative to the rearward edge to abut the surface adjacent to the seat and facilitate abutment of the stops with a forward inner edge of one of the toilet seat and toilet bowl.

17. The method of using the toilet seat as set forth in claim 16 further comprising the step of forming a linear track on one of the lower surface of the seat and the adjustment mechanism, and providing a spring biased engagement device for engaging in the linear track supported on the other of the lower surface of the seat and the adjustment mechanism.

* * * * *